US008448709B1

(12) United States Patent
Tseytlin

(10) Patent No.: US 8,448,709 B1
(45) Date of Patent: May 28, 2013

(54) METHOD OF KILLING AN UNCONTROLLED OIL-GAS FOUNTAIN APPEARED AFTER AN EXPLOSION OF AN OFFSHORE OIL PLATFORM

(76) Inventor: Simon Tseytlin, Middle Village, NY (US)

( * ) Notice: Subject to any disclaimer, the term of this patent is extended or adjusted under 35 U.S.C. 154(b) by 110 days.

(21) Appl. No.: 13/184,497

(22) Filed: Jul. 16, 2011

Related U.S. Application Data

(60) Provisional application No. 61/367,478, filed on Jul. 26, 2010.

(51) Int. Cl.
*E21B 7/12* (2006.01)
*E21B 29/12* (2006.01)
*E21B 34/04* (2006.01)

(52) U.S. Cl.
USPC ..... 166/363; 166/339; 166/364

(58) Field of Classification Search
USPC ..... 166/363, 339, 364, 368, 285, 381, 166/386, 387, 75.15, 179, 192, 193; 138/89
See application file for complete search history.

(56) References Cited

U.S. PATENT DOCUMENTS

| | | | | |
|---|---|---|---|---|
| 5,829,523 | A * | 11/1998 | North | 166/250.14 |
| 8,205,677 | B1 * | 6/2012 | Salkin | 166/363 |
| 2011/0290501 | A1 * | 12/2011 | Duncan et al. | 166/363 |
| 2011/0315394 | A1 * | 12/2011 | Wolinsky | 166/363 |

* cited by examiner

*Primary Examiner* — Matthew Buck
*Assistant Examiner* — James Sayre
(74) *Attorney, Agent, or Firm* — Boris Leschinsky

(57) ABSTRACT

A method for killing an uncontrolled fountain in an oil well following a blowout includes a serial lowering into the well of narrow flow restricting rods, each rod being sufficiently small in diameter to allow its insertion against a high well pressure urging the rods out of the well. Each subsequent rod reduces the cross-sectional area of the well and gradually reduces the flow of fluid discharge out of the well. Once the fountain is sufficiently reduced, the well may be killed using traditional sealing techniques such as pumping cement down the well.

14 Claims, 3 Drawing Sheets

METHOD OF KILLING AN UNCONTROLLED OIL-GAS FOUNTAIN APPEARED AFTER AN EXPLOSION OF AN OFFSHORE OIL PLATFORM

CROSS-REFERENCE DATA

This application is a regular US filing claiming the priority date benefit from a provisional U.S. Patent Application No. 61/367,478 by the same inventor filed 26 Jul. 2010, which is incorporated herein in its entirety by reference.

BACKGROUND

The present invention relates to a method and system for the extinction or "killing" of an offshore oil well after an explosion or a blowout causing an appearance of an uncontrolled fountain of oil fluids mixed with gas from the remaining part of the well. The term "oil well" is used herein to describe a well that produces any type of hydrocarbons including oil and gas, but which may also produce a gas condensate or water as part of the fluid mixture discharge that comes out of the well. The present invention more specifically relates to methods for controlling the fluid discharge by gradually decreasing fluid flow using a series of flow restrictor inserts.

In the field of offshore oil drilling, the oil wells are kept under control by means of a column of mud which provides a hydrostatic load sufficient for maintaining overpressure between the well and the external pressure at controlled values. This column of mud, also known as primary well control barrier, is present both inside the well and also in a pipe called riser which connects the drilling platform to the sea bottom.

At the sea bottom, moreover, in correspondence with the well heads, there are generally secondary well control devices, called blowout preventers or BOP, which act as valves which are configured to close the well in the case of uncontrolled discharges of fluids from the well itself.

Often during drilling or well exploration in gas and oil wells, a gas kick may enter into the well space. Gas exits the well reservoir and reaches the bottom hole of the well. If this is not detected immediately, this creates a gas bubble (gas kick) in the hole. Gas kick, according to Archimedes' principle begins to ascend within the annular space of the well. If not allowed to expand, it brings its initial high pressure equal to the formation pressure to the head of the well. At the same time, the pressure everywhere along the well begins to rise. If the BOP is closed, and there is no "washing" in the well, a hydrofracture of formation may occur. As a result, the drilling fluid enters the formation, and the well is filled with gas. If the drill pipe has no check valve, the gas also fills drill pipes up to the wellhead. This may cause a gas explosion that may result in human casualties, environmental pollution and the creation of an uncontrolled fountain. This uncontrolled fountain is very difficult to suppress, because the wellhead is under enormous pressure. As offshore drilling on the continental shelves is progressing into deeper and deeper waters, the problem is many times more complicated when the explosion occurs in deep waters. Suppressing such a well and cleaning of the environment may cost billions of dollars.

Presently known are various techniques for reestablishing the control of the well in case of a blowout, such as for example the techniques of bridging, capping, production of a relief well and assembling a string of pipes for the injecting cement down the well, such string is sometimes referred to as a killing string.

A killing intervention consists of the insertion of a specific string of pipes inside a blowout well. When inserted in the well, the killing string allows conventional killing techniques to be applied such as the circulation of heavy mud, closure by means of inflatable packers, and so forth. This method has proved to be the most rapid, but it can currently only be used in the case of well blowouts in shallow water, i.e. less than 1,000 m. In addition, in order to allow for the adequate flow of cement through the killing string, its internal diameter has to be sufficiently large such as at least 10 cm or more. Inserting such a large string of pipes presents a challenge due to an enormous pressure in the well urging the killing string out of the well.

To date, no practical equipment is available to the industry for the purpose of regaining the control of a deep water abandoned wellhead on the offshore seabed after a blowout causing spilling of reservoir fluids into the sea. The environmental pollution caused by such outpouring of reservoir liquids and gases can have disastrous consequences, as witnessed the recent pollution created over a large section of the Gulf of Mexico and adjacent beaches by the erupted well off the coast of Mexico.

There is a need for an improved method for killing of an uncontrolled fountain from an oil well following a blowout event.

SUMMARY OF THE INVENTION

Accordingly, it is an object of the present invention to overcome these and other drawbacks of the prior art by providing a novel method and a system for killing of the uncontrolled fountain in an offshore oil well by gradually decreasing fluid flow using a series of narrow rods to restrict flow.

In embodiments, the method of the invention includes providing a series of flow restricting rods having a cross-sectional area substantially lower than the cross-sectional area of the well. The shape of the inserts may be round. The rods may be placed one at a time inside the well until they fill enough of a cross-section of the well to cause a decrease in the fluid discharge coming out of the well. Once the flow of fluid is sufficiently low, conventional cement pumps which are traditionally used for terminating oil wells may be deployed to pump cement down the well and seal it off permanently.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE PREFERRED EMBODIMENT OF THE INVENTION

Figure 1:
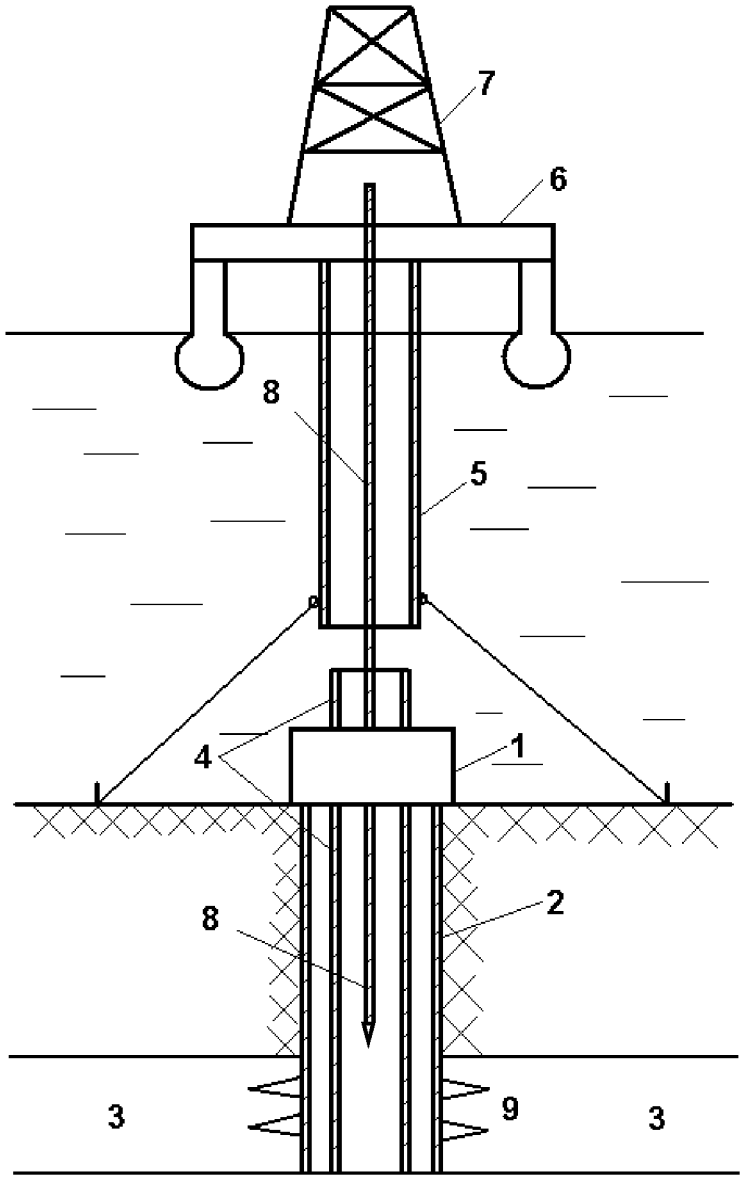
FIG. 1 is a side view of the oil well at the beginning stage of the killing operation to stop the uncontrolled fountain from the well.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

The method of the invention includes serial placement of flow restricting rods down the well in order to reduce the fluid discharge flow. These rods may be the same or having different size and shape. In embodiments, an exemplary insert is a metal rod, such as made from steel for example. The diameter of each rod may be from about 5 mm to about 40 mm. In embodiments, the rod diameter may be about 10 mm. A non-round rod may also be used.

The size of the rod may be selected based on the well pressure and its internal diameter. The pressure force pushing the rod out of the well is calculated using the size of the rod and the well pressure. In a typical offshore well, where the well pressure at the level of a seabed can reach hundreds of atmospheres or more and the weight of the rod made from steel may reach hundreds of kilograms, the range of diameters for the rod may be from about 20 $mm^2$ to about 1,200 $mm^2$.

The rod may be made solid and entirely from metal with no voids or passages therein. The end of the rod may be made tapered to facilitate insertion and advancement down the well. In embodiments, each rod made include long sections that can be attached to each other during the operation of insert placement down the well. In other embodiments, each rod may be brought to the well location on a spool and unfolded during the insertion procedure. Making each rod smaller in cross-sectional area allows reducing the force necessary for putting the rod down the well. Once a certain length of the rod is placed into the well, its own weight may help in further downwards advancement.

In embodiments, rods typically used as components in reciprocating piston rod pumps may be adapted to be used for the purposes if the present invention as flow restricting rods.

A blowout of a typical offshore well may produce a plume of fluid discharge with a pressure at the outlet of the well as high as 600 atmospheres. Given a typical tube diameter of 120 mm, inserting a full diameter plug of that diameter or even a smaller but sizable killing string down the hole is extremely difficult as it requires a tremendous level of force to overcome the pressure of the fluid discharge. At the same time, using a 10 mm rod reduces the cross-sectional area and therefore the force pushing the insert out of the well by 144 times—down to reasonable levels within the capabilities of modern technologies. Placing a long section of such rod down the well produces two effects that complement each other in reducing the flow of fluids out of the well—reduction in cross-sectional area available for fluid discharge and increase in friction along the walls of the well given the additional outer surface of the rods.

FIG. 1 illustrates the beginning of the process of killing of an uncontrolled fountain from an oil well, showing a blowout preventer 1, a well casing 2, formation 3, drilling tubes 4, a riser tube 5, a floating platform 6, a rig 7, a rod 8, and perforations 9.

Insertion of the rod 8 may start by positioning a riser tube 5 over the opening of the drilling tube 4 or any other suitable well opening remaining following an accident. In some cases, the riser tube may be anchored to the ocean floor as shown in FIG. 1. Placing of the first rod 8 into the well continues until it may encounter significant resistance or until it reaches the bottom of the well. As a result, the cross-section of the well along its entire length will decrease, and the resistance to the flow due to viscous friction against the inner surface of the well and the outer surface of the rod increases.

The procedure may then be repeated by inserting the next rod into the well. The flow rate and the wellhead pressure at that point may be reduced further. Serial insertion of several such rods (see FIG. 2) may significantly reduce the cross-section of the drill pipe 4, leading to a decrease in fluid discharge and the wellhead pressure—by one or two orders of magnitude in some cases. Once the pressure is sufficiently low, cementing operation may be undertaken so as to permanently seal off the well.

Figure 2:
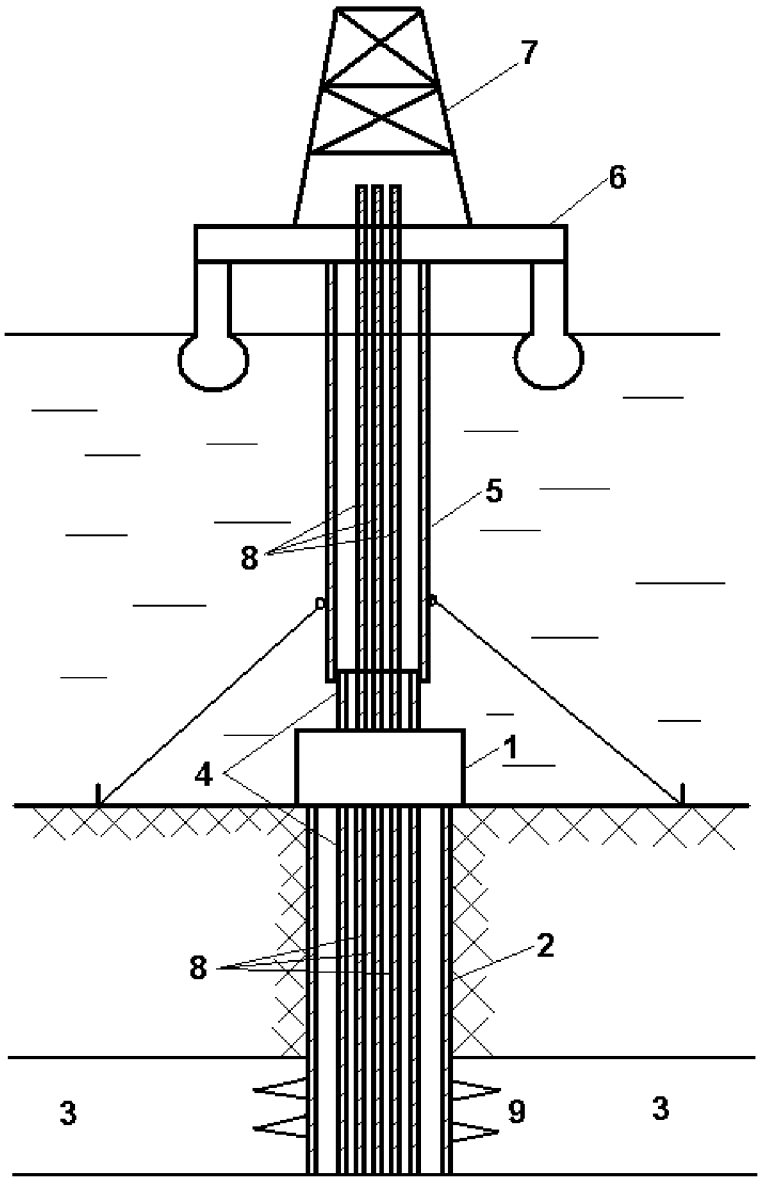
FIG. 2 is a side view of the oil well in its final stages of the killing operation.
Figure 3:
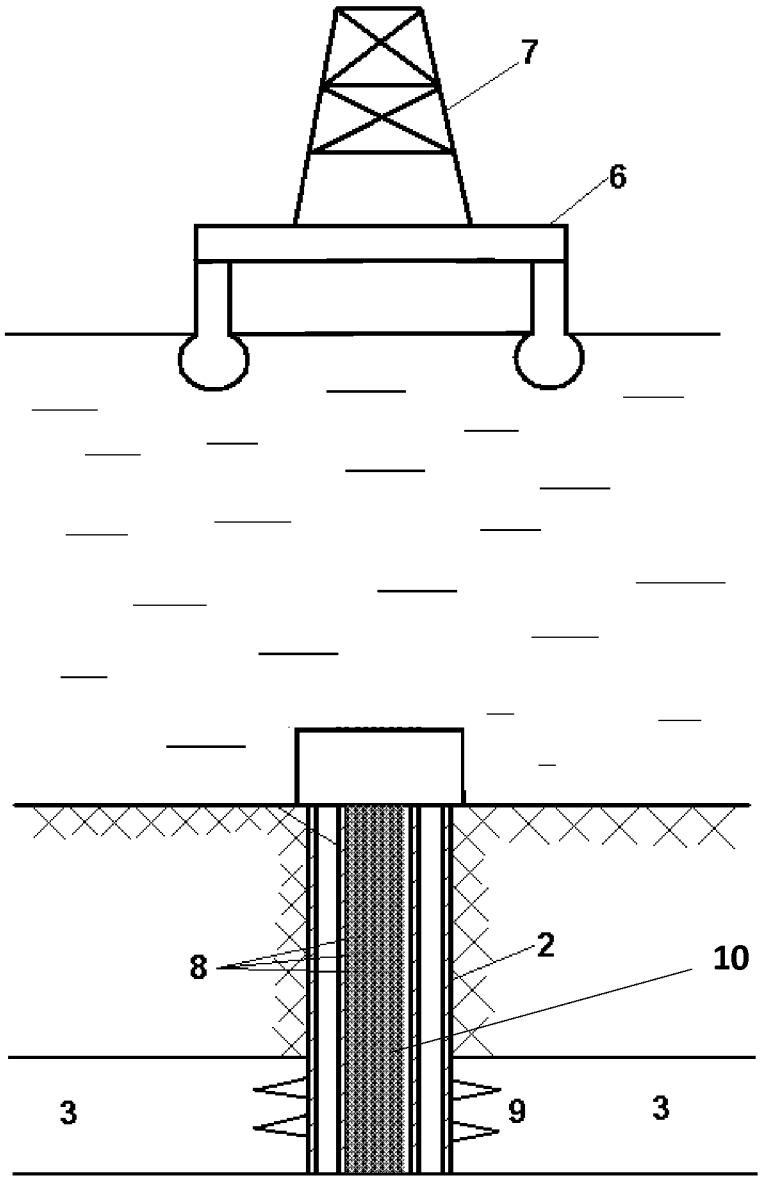
FIG. 3 shows the oil well after sealing with cement, separating and removing of the remaining portions of flow restricting rods and the riser.

The method of the invention includes the following necessary and optional steps:

1. Provide a plurality of flow restricting rods 8 using either a standard floating rig 7 or a ship located near an offshore platform;
2. Position a riser tube 5 over the drilling tube 4. Riser tube 5 may have an inner diameter slightly larger than the external diameter of the drilling tube 4. As a result, the lower end of the riser tube 5 may be placed over the head of the well at a distance of about several meters. Alignment and fixation of this riser tube 5 may be accomplished for example using a four-cable brace attached to the outer surface of the head of the well (see FIG. 1);
3. Place a first flow restricting rod 8 into the riser tube 5. To accomplish this, the first section of the rod 8 with the length which may be equal or less than the height of the drill rig, may be lowered using the usual method of lowering tubes. The second section of the rod 8 may then be attached to the end of the first section (such as using a threaded attachment), which may then be lowered into the riser tube 5. The process of lowering the rod 8 and attaching new sections thereto may be repeated until the lower section of the rod 8 appears suspended from the bottom of the riser tube 5. To assure entering the drilling tube 4, the first rod 8 may in some embodiments have a smaller diameter;
4. Place the lower end of the rod 8 into the drilling tube 4 at the well opening. Due to the small cross-section and significant weight (which could reach several hundred kilograms), the metal rod 8 can be easily placed inside the drilling tube 4 of the well;
5. Lower the rod 8 down the well until the lower section of the insert reaches the bottom of the well or until significant resistance is encountered. After that the rod 8 may be retained in place in order to prevent its release from the well;
6. Place the next rod 8 into the riser tube 5 and lower it down the well to reduce the cross section of the well even more. In embodiments, the lower end of the second rod 8 may be slidingly attached to the body of the first insert (using a ring for example—not shown) so as to assure it will find its way into the well opening and the drilling tube 4. This process may be continued until the wellhead pressure and flow rate of fluid decreases to safe enough levels, so that the well can be easily closed using the standard methods. In embodiments, such pressure at the well opening may be about 100 atmospheres. That pressure may be a result of a well pressure of about 200 atmospheres pushing the fluid discharge into the deep sea water at its own water column pressure of about 100 atmospheres such as encountered in wells located at about 1 km depth of water;

To accomplish a permanent closure of the well, the hanging riser tube 5 may be lowered so that the upper section of drilling tube 4 joins the bottom of the riser tube 5 (FIG. 2). Additional resistance of the suspended riser tube 5 connecting the wellhead to the drilling rig 7 further reduces the flow rate and wellhead pressure at the sea surface;

Cementing the well may now be accomplished. Mortar cement may be fed through the wellhead, which may be pushed into the well until the cement reaches the bottom hole, comes into the annular space of the well and covers the perforated section 9 of the casing from which the oil is coming out;

After cement 10 hardens, the flow from the well ceases completely. The riser tube 5 may be then separated (cut off) from the well as shown in FIG. 3. In embodiments, some of cement may seep through the gap between the top hanging riser tube 5 and the drilling tube 4, thus making their connection hermetic.

To accomplish the method of the invention, there is provided a system for killing of the uncontrolled fountain from an offshore well. The system included a plurality of narrow flow restricting rods, in which each insert may be made solid and sized to have a cross-sectional are from about 20 $mm^2$ to about 1,200 $mm^2$. The system further includes a rig and a riser tubing configured to accept sections or spools of such narrow rods therein and adapted to lower the rods one at a time down the opening of an offshore well.

The herein described subject matter sometimes illustrates different components or elements contained within, or connected with, different other components or elements. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Although the invention herein has been described with respect to particular embodiments, it is understood that these embodiments are merely illustrative of the principles and applications of the present invention. For example, the method and the system of the invention may be used in well located in shallow waters or on a dry land. It is therefore to be understood that numerous modifications may be made to the illustrative embodiments and that other arrangements may be devised without departing from the spirit and scope of the present invention as defined by the appended claims.

I claim:

1. A method for killing of an uncontrolled fountain from an offshore oil well comprising the steps of:

a. providing a plurality of flow restricting rods, each of said flow restricting rods is sized to have a cross-section area from about 20 $mm^2$to about 1,200 $mm^2$, each of said flow restricting rods comprising a series of straight sections configured for assembly with each other to form together said flow restricting rod, b. forming a first flow restricting rod by assembling a first series of said straight sections one at a time to extend said first flow restricting rod from a sea surface to a well opening, continuing to assemble additional straight sections for lowering the first flow restricting rod of said plurality into said well so as to reduce a cross-sectional area of said well to cause a reduction of said uncontrolled fountain, c. forming a second flow restricting rod by assembling a second series of said straight sections to extend said second flow restricting rod from said sea surface to said well opening, continuing to assemble additional straight sections for lowering the second flow restricting rod of said plurality into said well and positioning said second flow restricting rod adjacent to said first flow restricting rod, whereby further reducing the cross-sectional area of said well causing a further reduction in said uncontrolled fountain, d. serially assembling additional straight sections to form further flow restricting rods to extend from said sea surface to said well opening, lowering said additional flow restricting rods of said plurality one at a time and positioning thereof in said well adjacent to each other to minimize said uncontrolled fountain in said well, and e. sealing off said well to permanently stop said uncontrolled fountain.

2. The method as in claim 1, wherein said step (b) of lowering the first flow restricting rod into said well is accomplished by providing a riser tubing extending from above said opening of said oil well to said sea surface and inserting said flow restricting rods one at a time from said sea surface through said riser tubing and into said opening of said well.

3. The method as in claim 1, wherein said flow restricting rods are solid, made from metal and do not have any voids or passages therein.

4. The method as in claim 1, wherein said flow restricting rods are round and having a diameter from about 5 mm to about 40 mm.

5. The method as in claim 4, wherein said flow restricting rods are about 10 mm in diameter.

6. The method as in claim 1, wherein at least said first flow restricting rod has a tapered lower end to facilitate entrance thereof into said well.

7. The method as in claim 1, wherein said step (d) of lowering additional flow restricting rods is continued until well pressure is reduced to about 100 atmospheres.

8. The method as in claim 1, wherein said step (e) of sealing off said well is accomplished by pumping cement down said well once said fluid discharge is sufficiently minimized to allow said pumping.

9. The method as in claim 1, wherein said straight section have the same shape and size.

10. A method for killing of an uncontrolled fountain from an offshore oil well comprising the steps of:

a. extending a first flow restricting rod from a sea surface to a well opening, said flow restricting rod sized to fit inside said well opening;

b. lowering said first flow restricting rod to enter into said well opening;

c. further lowering said first flow restricting rod into said well opening until encountering resistance or reaching a bottom of the offshore oil well;

d. extending at least one additional flow restricting rod from said sea surface to said well opening and lowering thereof into said well, while continuing to extend the first flow restricting rod from the sea surface to the well opening and into the well, said at least one additional flow restricting rod positioned adjacent and parallel to said first flow restricting rod, whereby gradually reducing said uncontrolled fountain until it is minimized or stopped.

11. The method as in claim 10 further including a step of sealing off said well after said uncontrolled fountain has been minimized.

12. A method for killing of an uncontrolled fountain from an offshore oil well comprising the steps of:

a. providing a plurality of flow restricting rods sized to fit inside said well, b. suspending a first flow restricting rod to extend from a sea surface through an opening of said well and into said well;

c. suspending additional flow restricting rods to extend from said sea surface through said opening of said well and into said well, while continuing to suspend the first flow restricting rod and each additional rod extending from said sea surface through said opening of said well and into said well, said additional flow restricting rods positioned adjacent to each other and to said first flow restricting rod inside said well, whereby gradually reducing said uncontrolled fountain until it is minimized or stopped.

13. The method as in claim 12 further comprising sealing of said well, separating and removing of the portions of said flow restricting rods above said well opening.

14. The method as in claim 12, wherein a riser tube is further provided to extend from said sea surface to the vicinity of said well opening, said steps of suspending said first and said additional flow restricting rods is accomplished by lowering all flow restricting rods through said riser tube, said method further including a step of sealing said well by pumping cement through said riser into said well after said uncontrolled fountain is minimized.

* * * * *